US008244148B2

(12) United States Patent
Moriguchi

(10) Patent No.: US 8,244,148 B2
(45) Date of Patent: Aug. 14, 2012

(54) FIXING DEVICE AND IMAGE FORMING APPARATUS WITH TEMPERATURE CONTROL FUNCTIONS BASED ON SHEET SPEED AND FIXING PRESSURE

(75) Inventor: Motoki Moriguchi, Osaka (JP)

(73) Assignee: Kyocera Mita Corporation (JP)

( * ) Notice: Subject to any disclaimer, the term of this patent is extended or adjusted under 35 U.S.C. 154(b) by 26 days.

(21) Appl. No.: 12/564,104

(22) Filed: Sep. 22, 2009

(65) Prior Publication Data

US 2010/0074643 A1 Mar. 25, 2010

(30) Foreign Application Priority Data

Sep. 25, 2008 (JP) ..... 2008-246073

(51) Int. Cl.
*G03G 15/20* (2006.01)

(52) U.S. Cl. ..... 399/67

(58) Field of Classification Search ..... 399/67, 399/69, 43; 219/216, 469–471
See application file for complete search history.

(56) References Cited

U.S. PATENT DOCUMENTS

2004/0028423 A1 * 2/2004 Hashiguchi et al. ..... 399/69
2005/0196186 A1 * 9/2005 Suzuki

FOREIGN PATENT DOCUMENTS

| | | | |
|---|---|---|---|
| JP | 5-119664 | | 5/1993 |
| JP | 07160143 | A * | 6/1995 |
| JP | 2001142327 | A * | 5/2001 |
| JP | 2008185652 | A * | 8/2008 |

* cited by examiner

*Primary Examiner* — Walter L Lindsay, Jr.
*Assistant Examiner* — Milton Gonzalez
(74) *Attorney, Agent, or Firm* — Gerald E. Hespos; Michael J. Porco

(57) ABSTRACT

A fixing device for fixing a toner image to a sheet and has a fixing roller to be heated by a heat source and a pressure roller to be pressed into contact with the fixing roller. A switcher switches a pressing force between the fixing roller and the pressure roller between a first pressing force and a second pressing force lower than the first pressing force. A pressing force detector detects the pressing force between the fixing roller and the pressure roller and a temperature detector detects the temperature of the fixing roller. A storage device stores control data indicating a control temperature for the fixing roller predetermined in accordance with the number of sheets passing the fixing device, and a controller controls the temperature of the fixing roller to the control temperature by controlling the heat source in accordance with a signal sent from the pressing force detector.

24 Claims, 7 Drawing Sheets

FIXING DEVICE AND IMAGE FORMING APPARATUS WITH TEMPERATURE CONTROL FUNCTIONS BASED ON SHEET SPEED AND FIXING PRESSURE

BACKGROUND OF THE INVENTION

1. Field of the Invention

The present invention relates to a fixing device for fixing toner to a sheet and an image forming apparatus for forming and fixing a toner image on and to a sheet.

2. Description of the Related Art

An electrophotographic copier, printer, facsimile machine or a complex machine provided with functions of these may be illustrated as an image forming apparatus. Such an image forming apparatus is provided with a fixing device for fixing toner to a sheet. A certain type of the fixing device is provided with a fixing roller including a heater and a pressure roller to be pressed into contact with the fixing roller. A sheet having a toner image formed by an electrophotographic process transferred thereto is passed through a nip defined between the fixing roller and the pressure roller. In the nip, the toner on the sheet is melted to fix the toner image to the sheet. In order to control the temperature of the fixing roller, this type of the fixing device includes a temperature detector.

Japanese Unexamined Patent Publication No. H05-119664 discloses a fixing device suitably used to fix toner to a laminated sheet (e.g. envelope). In the fixing device disclosed in Japanese Unexamined Patent Publication No. H05-119664, a pressing force between a fixing roller and a pressure roller is variable and reduced while a laminated sheet passes. Meanwhile, this fixing device reduces a conveying speed of the laminated sheet and the temperature of the fixing roller. In this way, this fixing device creates an equivalent condition for fixing toner to the laminated sheet to that for fixing toner to one sheet. As a result, the fixing device disclosed in Japanese Unexamined Patent Publication No. H05-119664 may fix the toner to the laminated sheet without wrinkles or lateral displacement of the sheet due to a difference in circumferential speed (linear speed) between the fixing roller and the pressure roller while the laminated sheet passes between the fixing roller and the pressure roller. On the other hand, toner may be fixed to one sheet using a high pressing force, wherefore the warm-up time of the fixing roller can be shortened and the fixing device can be miniaturized.

A complicated mechanism for automatically switching a pressing force generally results in a high production cost and a high failure rate. A mechanism for manually switching a pressing force is inconvenient to a user. For example, if one user tries to print an ordinary copy sheet after another user printed some image on an envelope, he/she has to operate an image forming apparatus to switch the pressing force before he/she starts his/her printing.

SUMMARY OF THE INVENTION

An object of the present invention is to provide a method and an apparatus enabling a pressing force to be switched and enabling toner to be suitably fixed to a laminated sheet using a weak pressing force.

In order to accomplish this object, one aspect of the present invention is directed to a fixing device, comprising a fixing roller configured to be heated by a heat source; a pressure roller configured to be pressed into contact with the fixing roller; a switcher for switching a pressing force between the fixing roller and the pressure roller between a first pressing force and a second pressing force lower than the first pressing force; a pressing force detector for detecting the pressing force between the fixing roller and the pressure roller; a temperature detector for detecting the temperature of the fixing roller; a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector.

Another aspect of the present invention is directed to an image forming apparatus, comprising an image forming unit for forming a toner image on a sheet; and a fixing device for fixing the toner image formed by the image forming unit to the sheet, wherein the fixing device includes a fixing roller configured to be heated by a heat source; a pressure roller configured to be pressed into contact with the fixing roller; a switcher for switching a pressing force between the fixing roller and the pressure roller between a first pressing force and a second pressing force lower than the first pressing force; a pressing force detector for detecting the pressing force between the fixing roller and the pressure roller; a temperature detector for detecting the temperature of the fixing roller; a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector.

DETAILED DESCRIPTION OF THE PREFERRED EMBODIMENTS

Hereinafter, one embodiment of the present invention is described in detail with reference to the drawings. A term "sheet" used in the following description means, for example, a copy sheet, a coated paper, a cardboard, a tracing paper or another piece capable of bearing an image by toner fixing.

Figure 1:
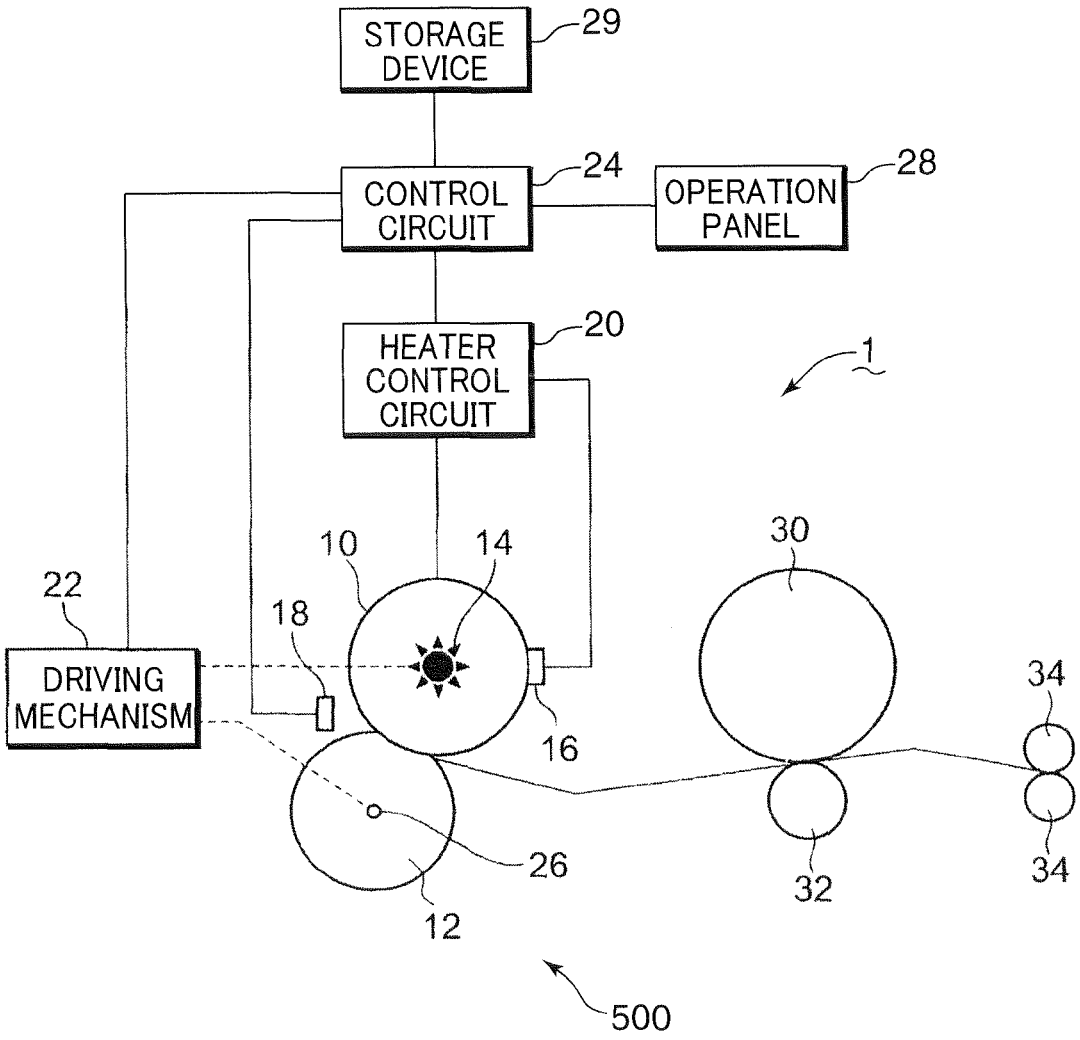
FIG. 1 is a schematic view showing a construction of an image forming apparatus according to one embodiment of the invention.

FIG. 1 is a schematic view showing a construction of an image forming apparatus according to one embodiment of the present invention. The image forming apparatus 1 includes a copier, a facsimile machine, a printer or another apparatus for forming an image using toner. The image forming apparatus 1 shown in FIG. 1 is provided with a photoconductive drum 30. The photoconductive drum 30 functions as an image forming unit for forming a toner image on a sheet.

The photoconductive drum 30 shown in FIG. 1 is an example of the image forming unit, thus the image forming unit may be a device configured to transfer a toner image formed on a belt to a sheet or any device configured to form a toner image on a sheet using toner.

An electrostatic latent image is formed on the circumferential surface of the photoconductive drum 30 by an electrophotographic process. Toner is supplied onto the circumferential surface of the photoconductive drum 30 from a developing device (not shown), whereby a toner image is formed on the circumferential surface of the photoconductive drum 30.

The image forming apparatus 1 shown in FIG. 1 includes a pair of registration rollers 34. The pair of registration rollers 34 is configured to convey a sheet to the photoconductive drum 30 while adjusting a sheet feeding timing with respect to the formation of a toner image on the photoconductive drum 30. A transfer roller 32 is disposed below the photoconductive drum 30. The toner image formed on the photoconductive drum 30 is transferred to the sheet while the sheet fed from the pair of registration rollers 34 passes between the photoconductive drum 30 and the transfer roller 32.

The image forming apparatus 1 shown in FIG. 1 includes a fixing device 500 comprising a fixing roller 10 and a pressure roller 12 to be pressed into contact with the fixing roller 10. A nip is defined between the fixing roller 10 and the pressure roller 12. The fixing roller may include the pressure roller 12 pressed into contact with a belt wound around a plurality of rollers or any structure configured to exert a pressure to a sheet although the fixing device 500 shown in FIG. 1 includes the pressure roller 12 pressed into contact with the single fixing roller 10.

The fixing roller 10 of the fixing device 500 shown in FIG. 1 may include, for example, an aluminum core of 20 mm in diameter, an elastic layer (for example, silicon rubber layer) of 3 mm in thickness formed along the outer circumferential surface of the core and a mold release layer containing fluoroplastic such as PFA and PTFE and formed on the outer surface of the elastic layer. Thus the fixing roller 10 may be, for example, 26 mm in outer diameter.

The pressure roller 12 may include, for example, a core made of aluminum, iron or the like of approximately 14 mm in diameter, an elastic layer (for example, silicon rubber layer) of approximately 5.5 mm in thickness formed along the outer circumferential surface of the core and a mold release layer containing fluoroplastic such as PFA and PTFE and formed on the outer surface of the elastic layer. Thus the pressure roller 12 may be, for example, 25 mm in outer diameter.

The heater 14 is incorporated into the core of the fixing roller 10 shown in FIG. 1. Although the heater 14 is shown as a heat source for heating the fixing roller 10, the heat source according to this embodiment may include a structure configured to heat the fixing roller 10 from the outside, a structure configured to electromagnetically heat the fixing roller 10 or any structure configured to give thermal energy to the sheet.

While the sheet passes the nip between the fixing roller 10 and the pressure roller 12, the toner forming the toner image on the sheet is melted and fixed to the sheet. The sheet having the toner image fixed thereto is, thereafter, discharged to the outside (e.g. a discharge tray (not shown)) of the image forming apparatus 1.

The image forming apparatus shown in FIG. 1 may include a thermistor 16 configured to function as a temperature detector for detecting the temperature of the fixing roller 10. The temperature detector may be a non-contact thermosensor or any detector configured to detect the temperature of the fixing roller 10.

Figure 2:
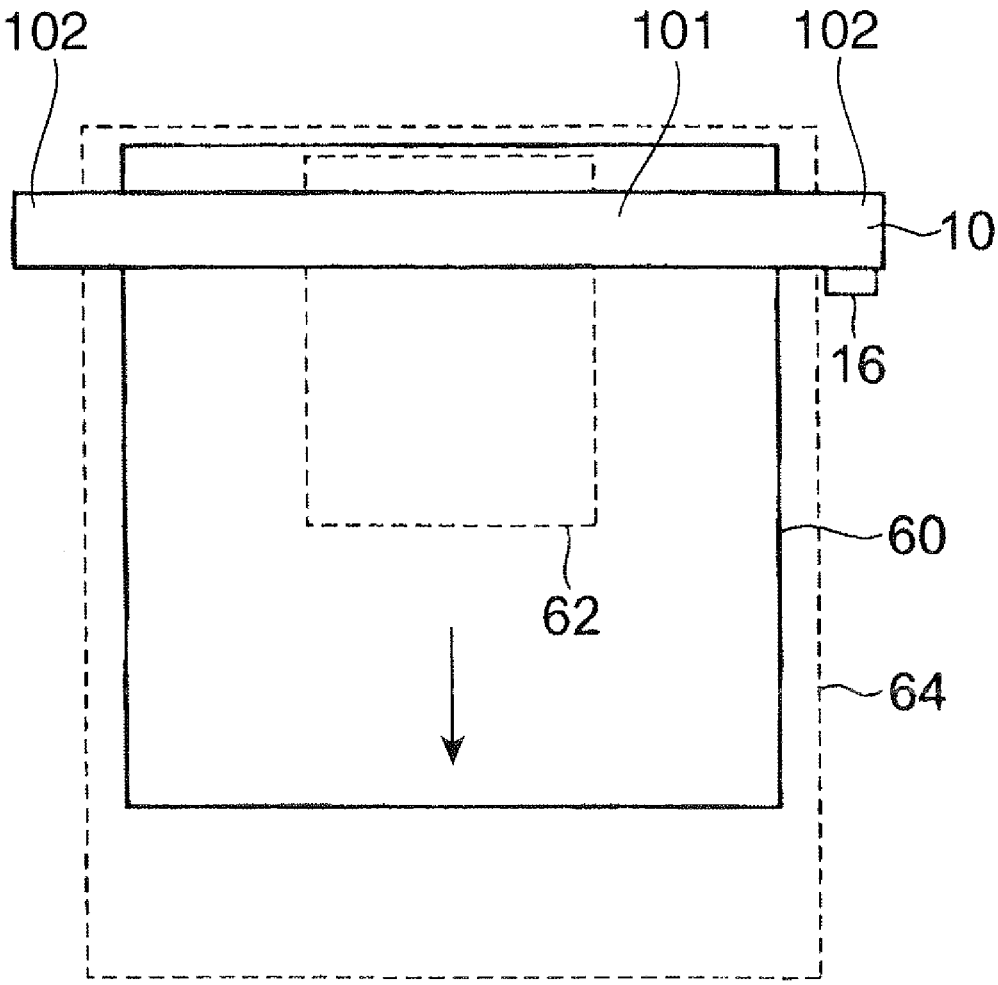
FIG. 2 shows the arrangement of a temperature detector shown in FIG. 1.

FIG. 2 shows a placement of the thermistor 16 as well as sheets 64, 60, 62 passing between the fixing roller 10 and the pressure roller 12. The sheet 64 has a maximum width out of sheets that may pass the fixing device 500. It should be noted that the term "width" means a dimension of the sheet in a direction orthogonal to a conveying direction (shown by an arrow in FIG. 2) of the sheets 64, 60 and 62. The fixing roller 10 is longer than the width of the sheet 64. Accordingly, both ends of the fixing roller 10 extend beyond edges of the sheet 64 (edges in parallel with the conveying direction of the sheet 64). The circumferential surface of the fixing roller 10 may be sectioned into a first outer circumferential surface 101 to be held in contact with the widest sheet 64 and second outer circumferential surfaces 102 not to be held in contact with the widest sheet 64. The thermistor 16 illustrated in FIG. 2 is fixed in contact with the second outer circumferential surface 102. The thermistor 16 may detect the temperature of the entire second outer circumferential surface 102 by the rotation of the fixing roller 10. Damage of the first outer circumferential surface 101 to be held in contact with the sheets 64, 60 and 62 can be avoided by arranging the thermistor 16 on the second outer circumferential surface 102, wherefore a proper fixing process may be guaranteed.

The sheet 64 may be, for example, a copy sheet of A3 size. The sheet 60 may be, for example, of a copy sheet of A4 size or letter size. The sheet 62 may be, for example, a laminated sheet formed by laminating a plurality of sheets such as an envelope.

Referring back to FIG. 1, the thermistor 16 is electrically connected to a heater control circuit 20. The thermistor 16 sends a signal corresponding to the temperature of the fixing roller 10 to the heater control circuit 20. The heater control circuit 20 functions as a controller configured to control the temperature of the heater 14. The controller may be a program for controlling the heater 14 or any means for controlling the temperature of the heat source.

Figure 3:
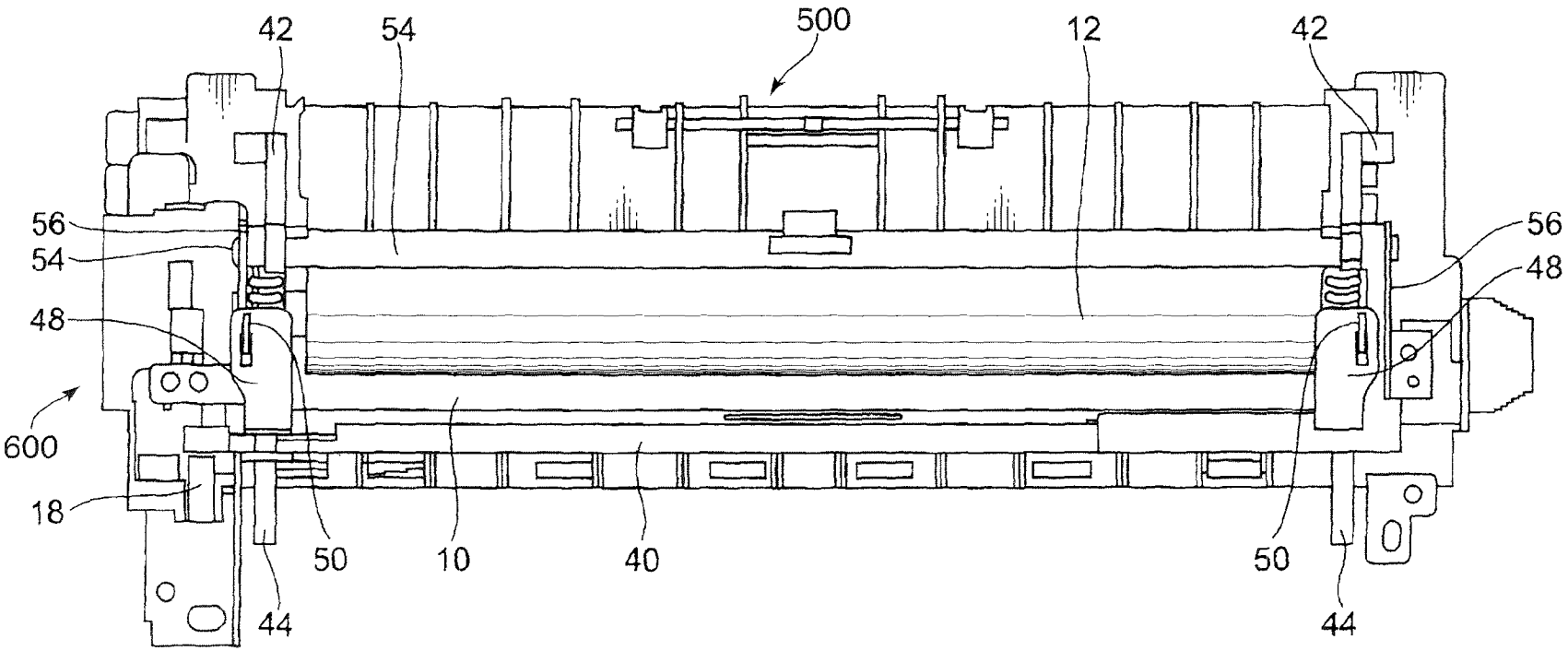
FIG. 3 is a schematic view showing a construction of a fixing device shown in FIG. 1, FIGS. 4A and 4B are perspective views showing a switcher of the fixing device shown in FIG. 3, FIGS. 5A and 5B show an operation of a pressure release lever of the switcher shown in FIGS. 4A and 4B, and FIGS. 6A and 6B are graphs showing control data stored in a storage device shown in FIG. 1.

FIG. 3 is a schematic view showing the entire fixing device 500. FIG. 3 shows a pressure release lever 40 and pressure levers 42 in addition to the fixing roller 10 and the pressure roller 12 shown in FIG. 1. The pressure release lever 40 is configured to reciprocate in parallel with a longitudinal direction of the pressure roller 12. A pressing force between the fixing roller 10 and the pressure roller 12 is determined by the position of the pressure release lever 40. The pressure levers 42 are configured to exert the pressing force determined by the pressure release lever 40 to the pressure roller 12. FIG. 3 also shows plates 48 and pressure plates 50.

Figure 4B:
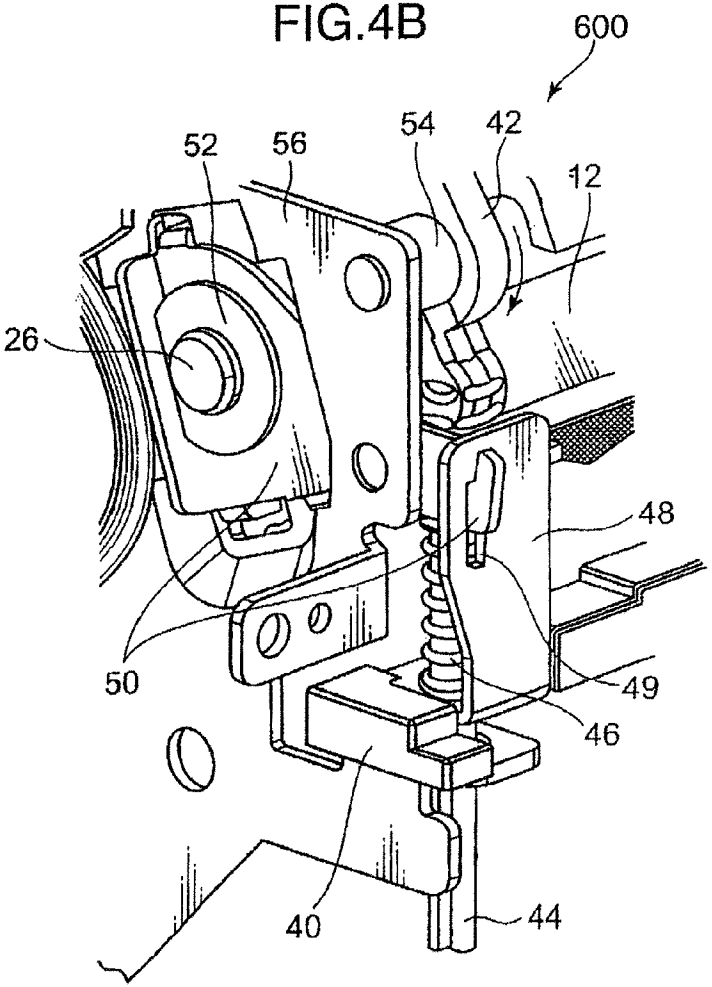
Figure 4A:
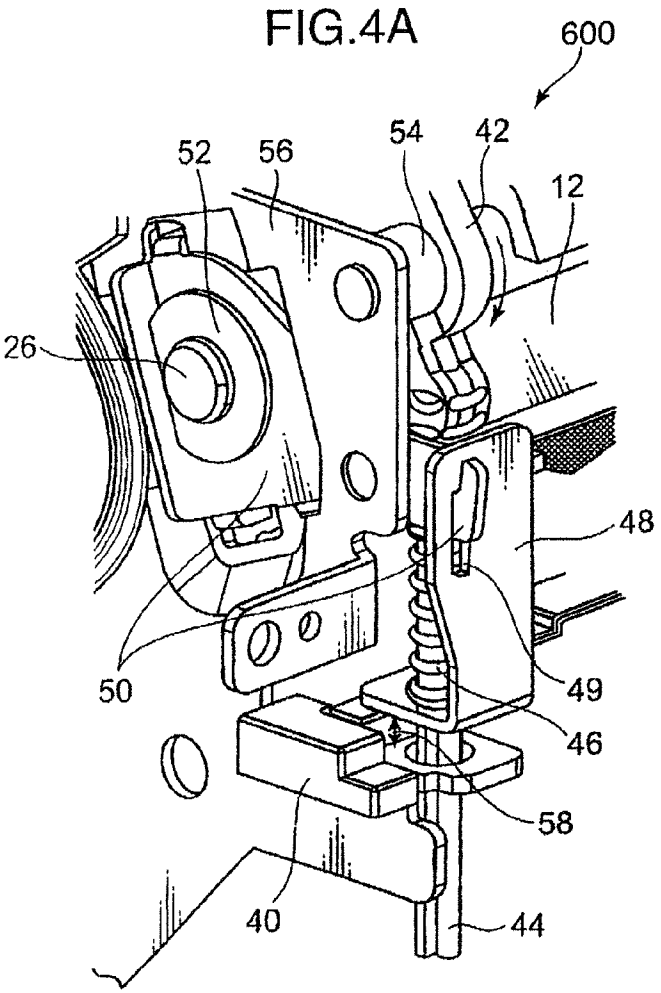

FIGS. 4A and 4B are perspective views showing a switcher located at the left end of the pressure roller 12 shown in FIG. 3 when viewed obliquely from behind. FIG. 4A shows a switcher 600 when a high pressing force (first pressing force) is produced between the fixing roller 10 and the pressure roller 12, and FIG. 4B shows the switcher 600 when a low pressing force (second pressing force) is exerted between the fixing roller 10 and the pressure roller 12. The pressing force is switched according to the type of a sheet passing the fixing device 500. For example, when the sheet 60 (e.g. copy sheet of letter size) shown in FIG. 2 passes, a high pressing force may be exerted between the fixing roller 10 and the pressure roller 12 through the operation of the switcher 600. On the other hand, when the sheet 62 (e.g. laminated sheet such as an envelope) shown in FIG. 2 passes, a low pressing force may be exerted between the fixing roller 10 and the pressure roller 12 through the operation of the switcher 600.

Figure 5A:
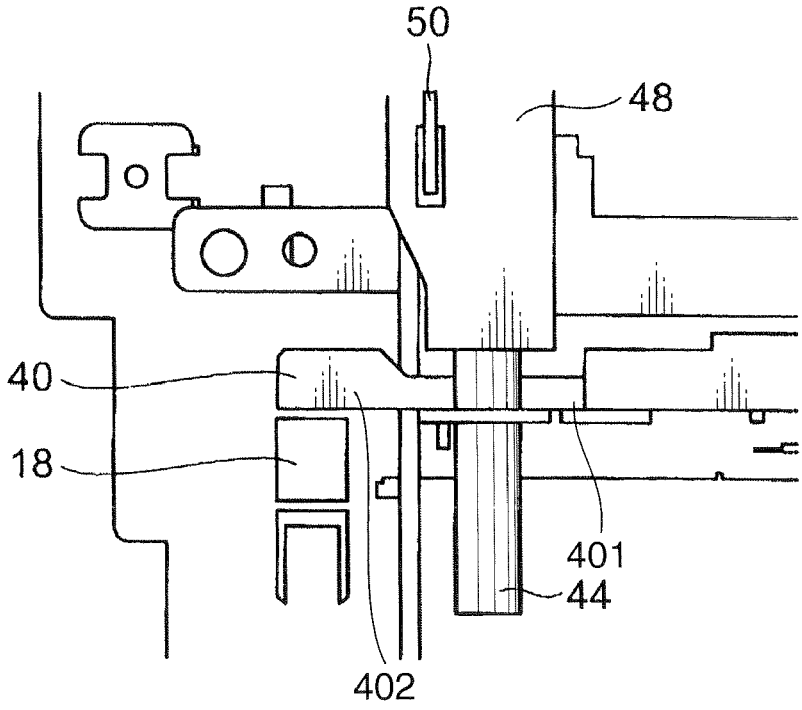
Figure 5B:
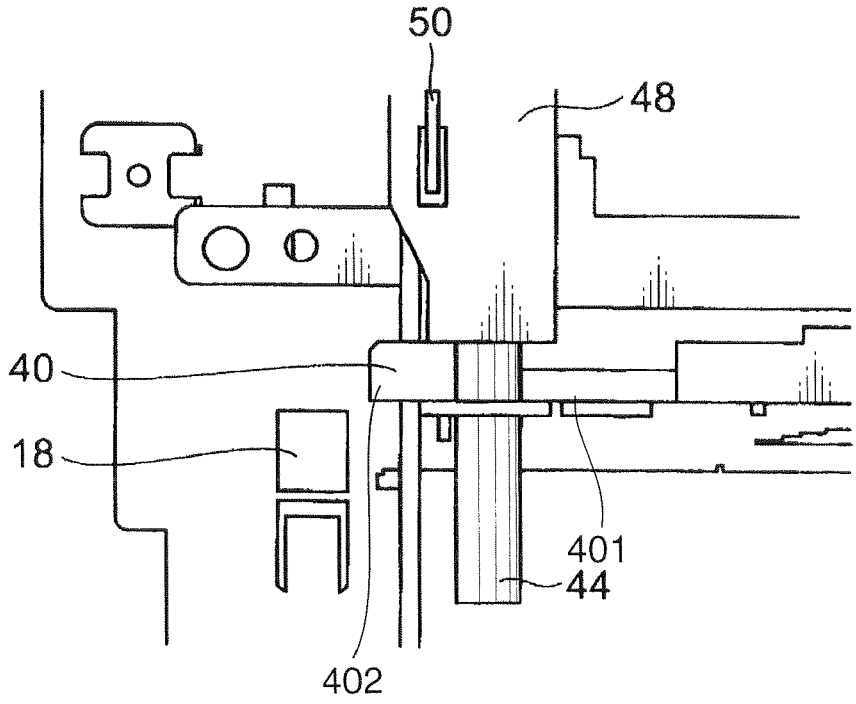

FIGS. 5A and 5B show positions of the pressure release lever 40. FIG. 5A shows the position (left position) of the pressure release lever 40 when the high pressing force (first pressing force) is exerted between the fixing roller 10 and the pressure roller 12, and FIG. 5B shows the position (right position) of the pressure release lever 40 when the low pressing force (second pressing force) is exerted between the fixing roller 10 and the pressure roller 12. The pressure release lever 40 includes a thin part 401 and a thick part 402 extending leftward from the thin part 401 and defining an end portion of the pressure release lever 40.

The switcher 600 includes the pressure lever 42 extending from an inner wall of a housing of the image forming apparatus 1 and held by a corresponding one of a pair of supporting members 56 located near the opposite ends of the pressure roller 12, a guide 44 attached to the pressure lever 42, a spring 46 coiled around the guide 44, the L-shaped plate 48 connected with the corresponding guide 44 and the pressure plate 50 including a leading end portion engageable with a slit 49 defined in the corresponding plate 48. The pressure lever 42 including a shaft 54 is attached to the corresponding supporting member 56 via the shaft 54. An external force exerted to the pressure lever 42 to rotate the shaft 54 in a direction of arrow shown in FIG. 4A moves the guide 44 downwardly. As a result, the plate 48 and the pressure plate 50 engaged with the slit 49 similarly move downward via the spring 46.

The pressure plate 50 includes a bearing 52 configured to be engaged with a shaft 26 of the pressure roller 12. By pressing the pressure plate 50 downward, the pressure roller 12 is pressed into contact with the fixing roller 10. Upon exerting a high pressing force (first pressing force) between the fixing roller 10 and the pressure roller 12 (see FIG. 4A), the pressure release lever 40 is located at the left position. Thus, the thin part 401 of the pressure release lever 40 is located below the plate 48. As a result, the pressure roller 12 is pressed into contact with the fixing roller 10 by a pressing force (stronger pressing force) increased by a downward movement amount of the plate 48 as shown by arrows 58 in FIG. 4A.

When a body cover (not shown) of the image forming apparatus 1 is opened, a user may access the pressure lever 42 to be operated. When the pressure lever 42 is operated to rotate the shaft 54 in a direction opposite to the one shown by arrow in FIG. 4A, the guide 44 attached to the pressure lever 42 is pushed upward. Further, the spring 46 into which the guide 44 is inserted, the plate 48 and the pressure plate 50 are similarly pushed upward. When the pressure plate 50 is pushed upward, the pressure of the pressure roller 12 against the fixing roller 10 is released by a rotational motion. At this time, the lower surface of the plate 48 is located above the upper surface of the thick part 402 of the pressure release lever 40, whereby the pressure release lever 40 may freely move in a lateral direction.

When the pressure release lever 40 is moved to the right (see FIG. 4B), the thick part 402 thereof is located below the plate 48. Thereafter, the pressure roller 12 may be pressed into contact with the fixing roller 10 as described above. At this time, a downward movement amount of the plate 48 is smaller than the one indicated by the arrows 58 in FIG. 4A. The movement of the pressure release lever 40 changes a movable distance of the plate 48 as well as a stroke of the spring 46, which decreases in the downward movement amount of the plate 48. The decrease in the downward movement amount weakens the pressing force of the pressure roller against the fixing roller 10. In this way, the fixing device 500 may be manually operated to change the pressing force.

FIGS. 5A and 5B show an optical sensor 18. The optical sensor 18 irradiates light upwardly. When the pressure release lever 40 is located at the left position (see FIG. 5A), light from the optical sensor 18 is reflected and the reflected light is detected by the optical sensor 18. On the other hand, when the pressure release lever 40 is located at the right position (see FIG. 5B), light from the optical sensor 18 is not reflected and no reflected light is detected by the optical sensor 18. Accordingly, the optical sensor 18 is capable of functioning as a pressing force detector for detecting a pressing force between the fixing roller 10 and the pressure roller 12. The pressing force detector may be a transmissive optical sensor including a light emitting element and a light receiving element. In the case of the transmissive optical sensor for the pressing force detector, when light irradiated from the light emitting element is detected by the light receiving element, the pressing force detector may send a signal indicating that the pressing force between the fixing roller 10 and the pressure roller 12 is large. Unless light irradiated from the light emitting element is detected by the light receiving element, the pressing force detector may send a signal indicating that the pressing force between the fixing roller 10 and the pressure roller 12 is small. The pressing force detector may also be any device capable of detecting the pressing force between the fixing roller 10 and the pressure roller 12.

Referring back to FIG. 1 again, the optical sensor 18 shown in FIG. 5 is diagrammatically shown in FIG. 1. As shown in FIG. 1, the optical sensor 18 is electrically connected to a control circuit 24. As described with reference to FIGS. 5A and 5B, the optical sensor 18 sends a signal corresponding to the magnitude of the pressing force between the fixing roller 10 and the pressure roller 12 to the control circuit 24.

FIG. 1 also shows a storage device 29, which may be any one of various memories such as a ROM and a RAM. The storage device 29 is electrically connected to the control circuit 24 and stores control data to be exchanged between the storage device 29 and the control circuit 24.

FIG. 1 also shows a driving mechanism 22 electrically connected to the control circuit 24. The driving mechanism 22 may be, for example, a motor. Although the driving mechanism 22 is a motor connected to the fixing roller 10 in this embodiment, it may be a motor connected to the pressure roller 12. In this embodiment, when the control circuit 24 receives a signal indicating a high pressing force between the fixing roller 10 and the pressure roller 12 from the optical sensor 18, the control circuit 24 sends a command signal to the driving mechanism 22 to increase the rotating speed of the fixing roller 10. Further, when the control circuit 24 receives a signal indicating a low pressing force between the fixing roller 10 and the pressure roller 12 from the optical sensor 18, the rotating speed of the fixing roller 10 is reduced. The control circuit 24 together with the heater control circuit 20 constructs the controller.

Figure 6A:
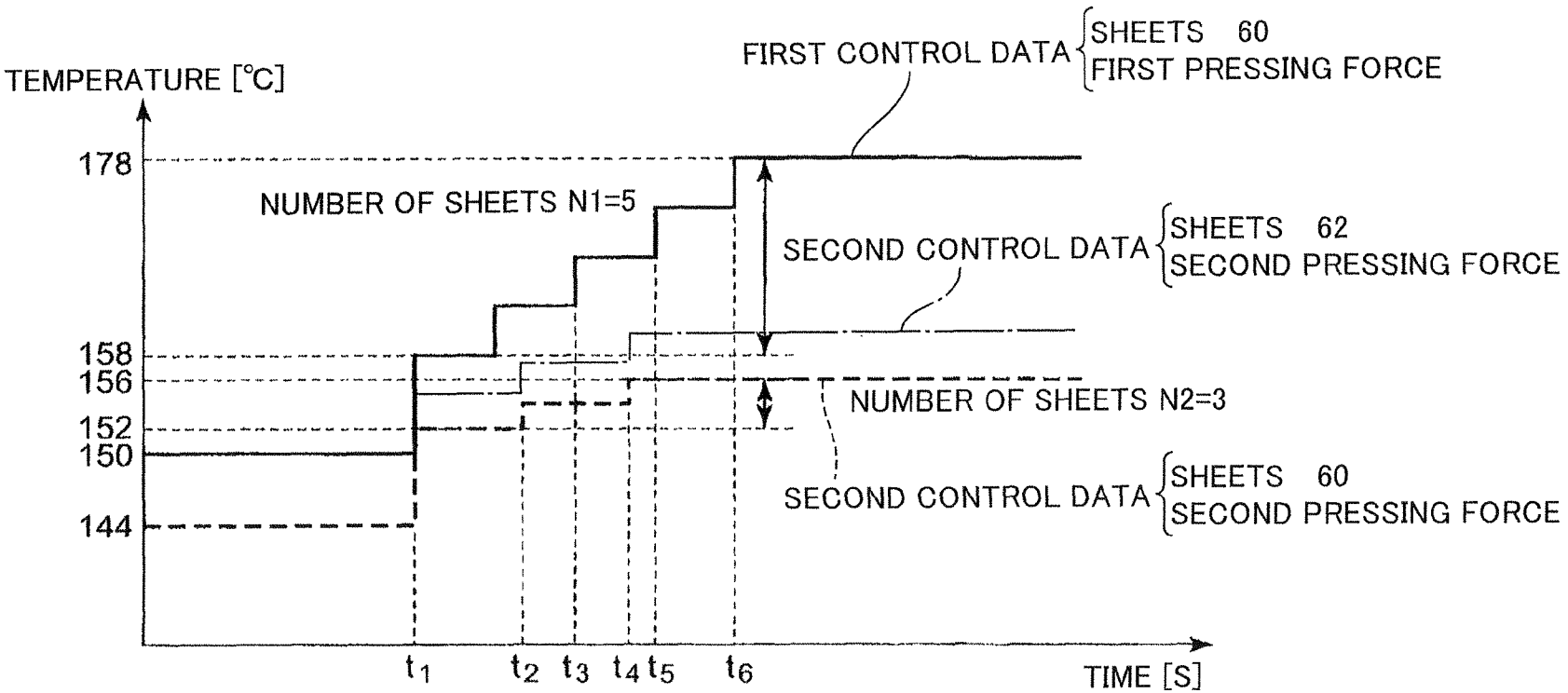
Figure 6B:
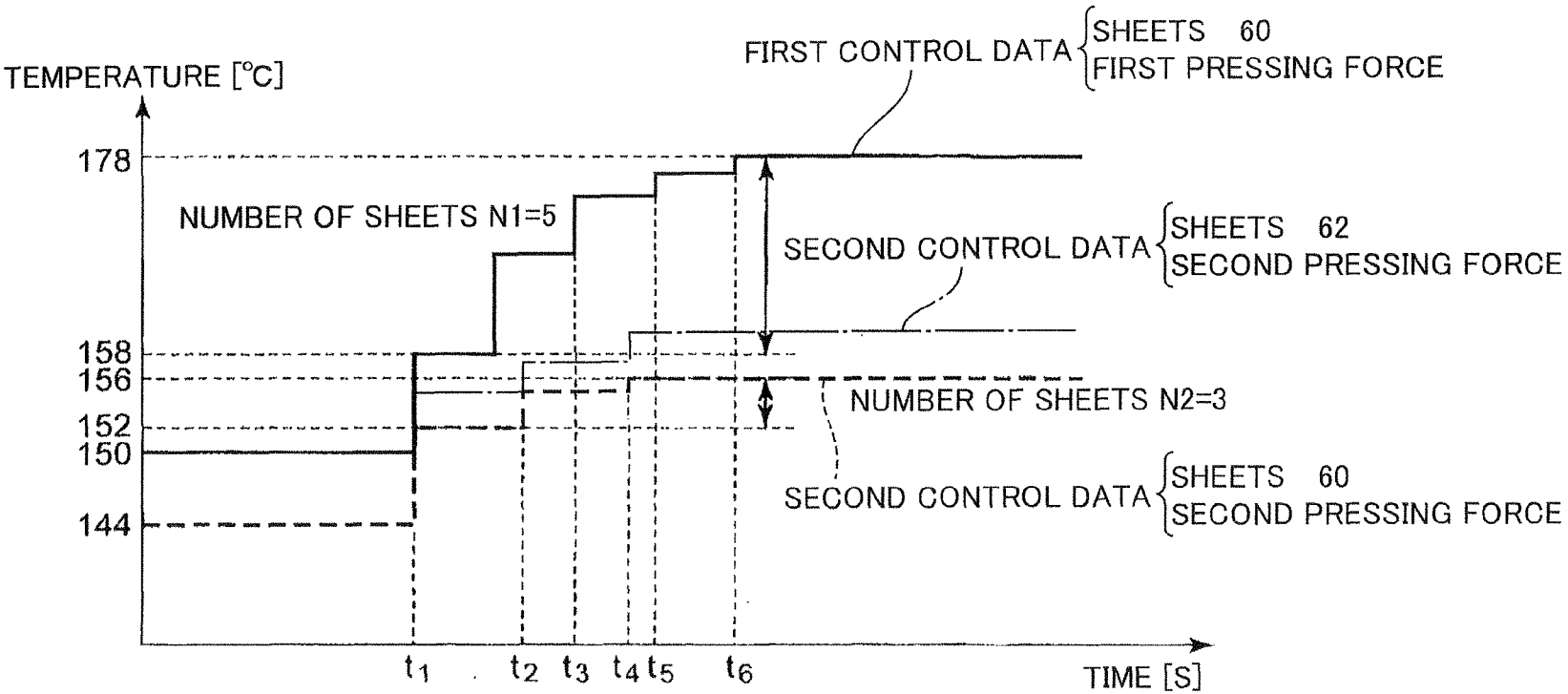

FIG. 6 shows control data stored in the storage device 29 shown in FIG. 1. A horizontal axis of a graph shown in FIG. 6 represents time (unit: s). A vertical axis of the graph represent temperature (unit: ° C.) indicated by the thermistor 16 disposed in contact with the fixing roller 10. A solid line (first control data) in the graph indicates a control temperature for the fixing roller 10 when the pressing force between the fixing roller 10 and the pressure roller 12 is set high (first pressing force), and a dotted line (second control data) in the graph indicates a control temperature for the fixing roller 10 when the pressing force between the fixing roller 10 and the pressure roller 12 is set low (second pressing force). The first control data indicates the control temperature under a high rotating speed (first rotating speed) of the fixing roller 10, whereas the second control data indicates the control temperature under a low rotating speed (second rotating speed) of the fixing roller 10. The first control data increases stepwise for a specified period following the start of the rotation of the fixing roller 10 (indicated by t1 in FIG. 6) and, thereafter, indicates a constant value (first maximum control temperature) regardless of the passage of time. The second control data increases stepwise for a specified period following the start of the fixing process by the fixing roller 10 (indicated by t1 in FIG. 6) and, thereafter, indicates a constant value (second maximum control temperature) regardless of the passage of time. The second maximum control temperature is lower than the first maximum control temperature. The second control data indicates values lower than the first control data until reaching the second maximum control temperature. The control circuit 24 reads the control data shown in FIG. 6 from the storage device 29 and sends a command signal to the heater control circuit 20. The heater control circuit 20 sends an operation signal to the heater 14 electrically connected to the heater control circuit 20 in accordance with the command signal from the control circuit 24 and executes such a control that the temperature of the fixing roller 10 reaches a target control temperature. Thus, a feedback loop for the temperature control of the fixing roller 10 is defined among the heater control circuit 20, the heater 14 and the thermistor 16.

A method for determining the control data illustrated in FIG. 6 is described. First of all, a relationship between the number of sheets 60, 62, 64 successively passing the fixing device 500 and temperature measured by the thermistor 16 and a relationship between the number of sheets 60, 62, 64 successively passing the fixing device 500 and actual temperature of the circumferential surface of the fixing roller 10 held in contact with the sheets 60, 62, 64 are empirically identified. In this way, heat quantity deprived by the sheets 60, 62, 64 and a difference between the actual temperature of the circumferential surface of the fixing roller 10 actually held in contact with the sheets 60, 62, 64 and the temperature indicated by the thermistor 16 are identified. For example, if narrowest sheets 62 are supposed to be envelopes, the above relationships may be identified under low-speed conditions and low-pressure conditions in conformity with laminated sheets (second control data). Based on the above experimental measurements, the control data shown in FIG. 6 are constructed / developed. FIG. 6 shows the control data (first control data and second control data) for the sheets 60 expected to be most frequently used and the control data (second control data) for the narrowest sheets 62.

For example, in this embodiment, the fixing roller 10 is rotated at a rotating speed (first rotating speed) higher than a fixing condition for the sheet 62 and the pressing force between the fixing roller 10 and the pressure roller 12 is set high (first pressing force) in the case of performing a fixing process for the sheet 60. For example, if the sheet 60 is a paper (plain paper) of 90 g/m$^2$ and a multitude of sheets 60 successively passes the fixing device 500, the control circuit 24 receives a signal indicating that the pressing force between the fixing roller 10 and the pressure roller 12 is the first pressing force from the optical sensor 18. In accordance with the signal from the optical sensor 18, the control circuit 24 sends a command signal to the driving mechanism 22 to adjust the rotating speed of the fixing roller 10 and/or the pressure roller 12 so that a conveying speed of the sheet reaches 170 mm/s. The control circuit 24 further sends a command signal to the heater control circuit 20 before image formation, whereby the temperature of the heater 14 is controlled so that the temperature detected by the thermistor 16 held in contact with the second outer circumferential surface 102 reaches 150° C. Thereafter, the control circuit 24 sends a command signal to the heater control circuit 20 to control the temperature of the heater 14 so that the temperature detected by the thermistor 16 reaches, for example, 158° C. when the first sheet 60 passes the fixing device 500.

The control circuit 24 may receive a signal indicating the successive passage of sheets 60, for example, from an operation panel 28 of the image forming apparatus 1. The control circuit 24 reads the first control data indicated in FIG. 6 from the storage device 29 and causes the heater control circuit 20 to control the heater 14 so that the temperature detected by the thermistor 16 increases stepwise, for example, by 5° C. every sheet to be subjected to the fixing process. The heater control circuit 20 controls the temperature of the heater 14 to a constant temperature of 178° C. for the fifth and succeeding sheets 60. When the control circuit 24 receives the signal indicating the successive passage of sheets 60 from the operation panel 28 of the image forming apparatus 1, the heater control circuit 20 may directly read the control data from the storage device 29. In the embodiment shown in FIG. 6, the control temperature is increased by 5° C. increments under the high pressing force (first pressing force) and the final detected temperature of the outer circumferential surface of the fixing roller 10 is 178° C. The number of sheets to be fixed until the final surface temperature (178° C.) of the fixing roller 10 is reached is set to five and a difference between the set temperature for the first sheet 60 and that for the fifth sheet 60 is about 20° C.

If the laminated sheet 62 (e.g. envelope) formed by laminating a plurality of sheets passes the fixing device 500 under the first pressing force, it may be wrinkled. Thus, through the operation described with reference to FIGS. 3 to 5, the second pressing force lower than the first pressing force is exerted between the fixing roller 10 and the pressure roller 12. At this time, the control circuit 24 receives a signal that the pressing force between the fixing roller 10 and the pressure roller 12 is set to the second pressing force from the optical sensor 18. Thereafter, the control circuit 24 sends a command signal to the driving mechanism 22 to control the rotating speed of the fixing roller 10 and/or the pressure roller 12 so as to set, for example, a conveying speed of 120 mm/s suitable to convey the envelope (sheet 62).

The second control data may be prepared for the sheets 60 under the second pressing force condition. Under the control in accordance with the second control data set for the sheets 60, the control circuit 24 sends a command signal to the heater control circuit 20 so that the thermistor 16 detects a temperature of 144° C. before image formation is performed to the sheets 60, and the heater control circuit 20 controls the heater 14 in accordance with the command signal. When the first sheet 60 passes, the heater control circuit 20 controls the heater 14 based on the second control data, for example, so that the temperature detected by the thermistor 16 held in contact with the second circumferential surface 102 reaches 152° C. When the second pressing force lower than the first pressing force is exerted between the fixing roller 10 and the pressure roller 12, the control circuit 24 reduces the conveying speed of the sheet 60 and a fixing temperature for fixing a toner image to the sheet 60 as compared with a control based on the first control data.

The control circuit 24 receives a signal indicating the successive passage of sheets 60, for example, from the operation panel 28 of the image forming apparatus 1. The control circuit 24 reads the second control data indicated in FIG. 6 from the storage device 29 and causes the heater control circuit 20 to control the heater 14 so that the temperature detected by the thermistor 16 increases stepwise, for example, by 2° C. every sheet to be subjected to the fixing process. The heater control circuit 20 controls the temperature of the heater 14 to a constant temperature of 156° C. for the third and succeeding sheets 60. When the control circuit 24 receives the signal indicating the successive passage of sheets 60 from the operation panel 28 of the image forming apparatus 1, the heater control circuit 20 may directly read the control data from the storage device 29. In the embodiment shown in FIG. 6, the control temperature is increased by 2° C. increments under the low pressing force (second pressing force) and the final detected temperature of the outer circumferential surface of the fixing roller 10 is 156° C. Further, the number of sheets to be fixed until the final surface temperature (156° C.) of the fixing roller 10 is reached is set to three. Under the second control data, the temperature increment, the number of the sheets 60 until the final temperature is reached and a difference between the set temperature for the first sheet 60 and that for the second sheet 60 are all set lower as compared with the first control data.

When the envelopes (sheets 62) pass the fixing device 500, the control circuit 24 first receives a signal indicating the successive passage of the envelopes (sheets 62) from the operation panel 28. The control circuit 24 or the heater control circuit 20 reads the control data stored in the storage device 29 and the heater control circuit 20 controls the temperature of the heater 14 based on the second control data prepared for the sheets 62. In the embodiment shown in FIG. 6, the second control data prepared for the envelopes (sheets 62) indicates temperature higher than the second control data prepared for the sheets 60. A final temperature (maximum control temperature) of the second control data for the envelopes (sheets 62) is higher than that of the second control data for the sheets 60, but the number of the sheets 62 until the final temperature is reaches is three as with the sheets 60. Accordingly, a temperature increment until the final temperature is reached is set to be larger in the second control data for the sheets 62 than in the second control data for the sheets 60. The final temperature, the temperature increment and the number of the sheets 62 until the final temperature is reached, which are set for the second control data prepared for the sheets 62, are set to be smaller than those of the first control data.

Although the conveying speed of the sheets 60 and that of the sheets 62 are equal under the second control data in the above embodiment, the control circuit 24 may control the driving mechanism 22 to differentiate these conveying speeds. Generally, the temperature control values are set lower as the conveying speeds of the sheets 60, 62 decrease, but the present invention is not limited thereto. When the conveying speed of the sheets 60 is set to be below the above conveying speed condition of 170 mm/s and higher than 120 mm/s under a control based on the second control data prepared for the sheets 60, the heat quantity deprived of the fixing roller 10 is reduced because the passage time of the sheets in the nip between the fixing roller 10 and the pressure roller 12 is shortened, whereas the heat quantity transferred to the sheets 60 is also reduced. Thus, depending on the type of the sheets 60, the control temperature for the first sheet 60 and the final control temperature in the second control data may be set higher than those in the first control data. At this time, since the heat quantity deprived of the fixing roller 10 is small, a difference between the control temperature set for the first sheet 60 and the final control temperature may be reduced and a temperature increment until the final temperature is reached and/or the number of the sheets 60 until the final temperature is reached may be set smaller.

Although the temperature increment until the final control temperature is reached is fixed in the above embodiment, the present invention is not limited thereto. For example, it is also possible to, in the first control data, set a difference between the control temperature set for the first sheet 60 and that set for the second sheet 60 to 10° C., set a difference between the control temperature set for the second sheet 60 and that set for the third sheet 60 to 6° C., set a difference between the control temperature set for the third sheet 60 and that set for the fourth sheet 60 to 3° C. and set a difference between the control temperature set for the fourth sheet 60 and that set for the fifth sheet 60 to 1° C. In this way, an increment of the set control temperature may be reduced as the number of the sheets 60 passing the fixing device 500 increases. The optimization of the control temperature increments results in preferable fixing of toner images.

The above embodiment mainly contains the following features.

A fixing device according to one aspect of the above embodiment fixes a toner image to a sheet. This fixing device comprises a fixing roller configured to be heated by a heat source; a pressure roller configured to be pressed into contact with the fixing roller; a switcher for switching a pressing force between the fixing roller and the pressure roller between a first pressing force and a second pressing force lower than the first pressing force; a pressing force detector for detecting the pressing force between the fixing roller and the pressure roller; a temperature detector for detecting the temperature of the fixing roller; a storage device for storing control data indicating a target temperature for the fixing roller predetermined in accordance with the number of sheets passing the fixing device; and a controller for controlling the temperature of the fixing roller to the target temperature by controlling the heat source in accordance with a signal sent from the pressing force detector.

According to the above feature, a toner image may be fixed, for example, under two pressing force conditions for most frequently used sheets. Further, one of the two pressing force conditions may be compatible, for example, for another type of sheets required to fix toner images with a lower pressing force. In this way, a highly convenient fixing device may be provided without requiring any operation to change the pressing force condition every time the sheet type is changed.

In the above feature, the controller preferably further controls at least one of the rotating speeds of the fixing roller and the pressure roller. In this feature, the controller controls the rotating speed to a first rotating speed when the pressing force detector detects the first pressing force while controlling the rotating speed to a second rotating speed lower than the first rotating speed when the pressing force detector detects the second pressing force. According to this feature, toner images may be suitably fixed, for example, to both of one layer sheet and to a sheet formed by laminating a plurality of sheets, wherefore neither a fixing failure nor an offset of a toner image occurs.

In the above feature, the control data may include first control data indicating the control temperature under the first pressing force and second control data indicating the control temperature under the second pressing force. In this feature, the first control data may indicate the control temperature under the first rotating speed condition and the second control data may indicate the control temperature under the second rotating speed condition. According to this feature, a suitable control temperature may be set according to a conveying speed of the sheet.

In the above feature, the fixing roller includes a first circumferential surface to be held in contact with the sheet and a second circumferential surface not to be held in contact with the sheet; and the temperature detector is so arranged as to be held in contact with the second circumferential surface. According to this feature, damage of the first circumferential surface to be held in contact with the sheet may be prevented, wherefore a proper fixing process may be performed.

In the above construction, the first control data includes a first maximum control temperature indicating the control temperature and constant in relation to an increase in the number of passed sheets, the second control data includes a second maximum control temperature indicating the control temperature and constant in relation to an increase in the number of passed sheets, and the second maximum control temperature is lower than the first maximum control temperature. In this feature, the control temperature of the first control data may increase stepwise until the first maximum control temperature is reached. In this feature, the control temperature of the second control data may increase stepwise until the second maximum control temperature is reached. In this feature, the control temperature of the second control data is below the control temperature of the first control data. In this feature, an increment of the control temperature of the first control data may be fixed. In this feature, an increment of the control temperature of the second control data may be fixed. In another specific embodiment, the increment of the control temperature of the first control data may decrease as the first maximum control temperature approaches. Further, the increment of the control temperature of the second control data may decrease as the second maximum control temperature approaches. In this way, suitable temperatures may be set under the respective fixing conditions.

In the above feature, the switcher may be manually operated. According to this feature, the structure of the fixing device may be simplified as compared with the automatic switcher.

An image forming apparatus according to another aspect of the above embodiment is for forming and fixing a toner image on and to a sheet, and comprises an image forming unit for forming a toner image on a sheet; and a fixing device for fixing the toner image formed by the image forming unit to the sheet. The fixing device includes a fixing roller configured to be heated by a heat source; a pressure roller configured to be pressed into contact with the fixing roller; a switcher for switching a pressing force between the fixing roller and the pressure roller between a first pressing force and a second pressing force lower than the first pressing force; a pressing force detector for detecting the pressing force between the fixing roller and the pressure roller; a temperature detector for detecting the temperature of the fixing roller; a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector.

This application claims priority to Japanese Patent Application Serial Number 2008-246073, filed on Sep. 25, 2008 by at least one common inventor, and which is incorporated herein by reference in its entirety.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device for fixing a toner image to a sheet selected from a laminated sheet and a non-laminated sheet, comprising:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and a second maximum control temperature indicating the control temperature and constant in relation to an increase in the number of passed sheets, the second maximum control temperature is lower than the first maximum control temperature, and the second maximum control temperature of the second control data provided for the laminated sheet is greater than the second maximum control temperature of the second control data provided for the non-laminated sheet.

2. The fixing device according to claim 1, wherein:

the first control data indicates the control temperature under the first rotating speed condition; and the second control data indicates the control temperature under the second rotating speed condition.

3. The fixing device according to claim 1, wherein:

the fixing roller includes a first circumferential surface to be held in contact with the sheet and a second circumferential surface not to be held in contact with the sheet; and the temperature detector is so arranged as to be held in contact with the second circumferential surface.

4. The fixing device according to claim 1, wherein the control temperature of the first control data increases stepwise until the first maximum control temperature is reached.

5. The fixing device according to claim 4, wherein an increment of the control temperature of the first control data is fixed.

6. The fixing device according to claim 4, wherein an increment of the control temperature of the first control data decreases as the first maximum control temperature approaches.

7. The fixing device according to claim 1, wherein:

the control temperature of the first control data increases stepwise until the first maximum control temperature is reached;

the control temperature of the second control data increases stepwise until the second maximum control temperature is reached; and the control temperature of the second control data is below the control temperature of the first control data.

8. The fixing device according to claim 1, wherein:

a temperature rise of the fixing roller by the heat source controlled with the first control data is greater than a temperature rise of the fixing roller by the heat source controlled with the second control data when a predetermined number of the sheets pass through the fixing device.

9. The fixing device according to claim 1, wherein the second control data prepared for the laminated sheet represents greater temperature than the second control data prepared for the non-laminated sheet.

10. The fixing device according to claim 1, wherein the first control data is provided for the non-laminated sheet.

11. A fixing device for fixing a toner image to a sheet selected from a laminated sheet and a non-laminated sheet, comprising:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and second maximum control temperature indicating the control temperature and constant in relation to an increase in the number of passed sheets, the second maximum control temperature is lower than the first maximum control temperature, the control temperature of the second control data increases stepwise until the second maximum control temperature is reached, an increment of the control temperature of the second control data is fixed, the control temperature of the first control data increases stepwise until the first maximum control temperature is reached, and an increment of the control temperature of the first control data is greater than the increment of the control temperature of the second control data.

12. The fixing device according to claim 11, wherein an increment of the control temperature of the second control data decreases as the second maximum control temperature approaches.

13. The fixing device according to claim 11, wherein:

the fixing roller includes a first circumferential surface to be held in contact with the sheet and a second circumferential surface not to be held in contact with the sheet; and the temperature detector is so arranged as to be held in contact with the second circumferential surface.

14. An image forming apparatus for forming and fixing a toner image on and to a sheet selected from a laminated sheet and a non-laminated sheet, comprising:

an image forming unit for forming a toner image on a sheet; and a fixing device for fixing the toner image formed by the image forming unit to the sheet, wherein the fixing device includes:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting the temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet and data prepared for the non-laminated sheet and a second maximum control temperature indicating the control temperature and constant in relation to an increase in the number of passed sheets, the second maximum control temperature is lower than the first maximum control temperature, and the second maximum control temperature of the second control data provided for the laminated sheet is greater than the second maximum control temperature of the second control data provided for the non-laminated sheet.

15. The image forming apparatus according to claim 14, further comprising:

an operation panel configured to receive input to select the laminated sheet or the non-laminated sheet.

16. A fixing device for fixing a toner image to a sheet selected from a laminated sheet and a non-laminated sheet, comprising:

a fixing roller configured to be heated by a heat source;

a pressure roller continued to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and a second maximum control temperature indicating the control temperature and constant in relation to an increase in the number of passed sheets, the second maximum control temperature is lower than the first maximum control temperature, and the first maximum control temperature is set to allow passage of more sheets than in the second maximum control temperature.

17. The fixing device according to claim 16, wherein:

the fixing roller includes a first circumferential surface to be held in contact with the sheet and a second circumferential surface not to be held in contact with the sheet; and the temperature detector is so arranged as to be held in contact with the second circumferential surface.

18. A fixing device for fixing a toner image to a sheet selected from a laminated sheet and a non-laminated sheet, comprising:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and a second maximum control temperature indicating the control temperature and constant in relation to an increase in the number of passed sheets, and the second maximum control temperature of the second control data provided for the laminated sheet is greater than the second maximum control temperature of the second control data provided for the non-laminated sheet.

19. The fixing device according to claim 18, wherein:

the fixing roller includes a first circumferential surface to be held in contact with the sheet and a second circumferential surface not to be held in contact with the sheet; and the temperature detector is so arranged as to be held in contact with the second circumferential surface.

20. A fixing device for fixing a toner image to a sheet selected from a laminated sheet and a non-laminated sheet, comprising:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and a second maximum control temperature indicating the control temperature and constant in relation to an increase in the number of passed sheets, and the first maximum control temperature is set to allow passage of more sheets that in the second maximum control temperature.

21. The fixing device according to claim 20, wherein:

the fixing roller includes a first circumferential surface to be held in contact with the sheet and a second circumferential surface not to be held in contact with the sheet; and the temperature detector is so arranged as to be held in contact with the second circumferential surface.

22. A fixing device for fixing a toner image to a sheet selected from a laminated sheet and a non-laminated sheet, comprising:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and a second maximum control temperature indicating the control temperature and constant in relation to an increase in the number of passed sheets, the control temperature of the second control data increases stepwise until the second maximum control temperature is reached, an increment of the control temperature of the second control data is fixed, the control temperature of the first control data increases stepwise until the first maximum control temperature is reached, and an increment of the control temperature of the first control data is greater than the increment of the control temperature of the second control data.

23. The fixing device according to claim 22, wherein:

the fixing roller includes a first circumferential surface to be held in contact with the sheet and a second circumferential surface not to be held in contact with the sheet; and the temperature detector is so arranged as to be held in contact with the second circumferential surface.

24. A fixing device for fixing a toner image to a sheet selected from a laminated sheet and a non-laminated sheet, comprising:

a fixing roller configured to be heated by a heat source;

a pressure roller configured to be pressed into contact with the fixing roller;

a switcher manually operable to switch a pressing force between the fixing roller and the pressure roller between a first pressing force and a second pressing force lower than the first pressing force;

a pressing force detector for detecting the pressing force between the fixing roller and the pressure roller;

a temperature detector for detecting a temperature of the fixing roller;

a storage device for storing control data indicating a control temperature for the fixing roller predetermined in accordance with the number of sheets passing the fixing device; and a controller for controlling the temperature of the fixing roller to the control temperature by controlling the heat source in accordance with a signal sent from the pressing force detector and for controlling at least one of the rotating speeds of the fixing roller and the pressure roller; wherein the controller controls the rotating speed to a first rotating speed when the pressing force detector detects the first pressing force while controlling the rotating speed to a second rotating speed lower than the first rotating speed when the pressing force detector detects the second pressing force, the control data includes first control data indicating the control temperature under the first pressing force and second control data indicating the control temperature under the second pressing force, the first control data includes a first maximum control temperature indicating the control temperature and constant in relation to an increase in the number of passed sheets, the second control data includes data prepared for the laminated sheet, data prepared for the non-laminated sheet and a second maximum control temperature indicating the control temperature and constant in relation to an increase in the number of passed sheets, the control temperature of the second control data increases stepwise until the second maximum control temperature is reached, an increment of the control temperature of the second control data decreases as the second maximum control temperature approaches, the control temperature of the first control data increases stepwise until the first maximum control temperature is reached, and an increment of the control temperature of the first control data is greater than the increment of the control temperature of the second control data.

* * * * *